US006193108B1

(12) United States Patent
Lepsius et al.

(10) Patent No.: US 6,193,108 B1
(45) Date of Patent: Feb. 27, 2001

(54) CARTRIDGE SYSTEM

(75) Inventors: Tilwin Lepsius, Duesseldorf; Wolfgang Klauck, Meerbusch; Lydia Duhm, Duesseldorf; Michael Dziallas, Haan, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/381,114

(22) PCT Filed: Mar. 6, 1998

(86) PCT No.: PCT/EP98/01329

§ 371 Date: Nov. 16, 1999

§ 102(e) Date: Nov. 16, 1999

(87) PCT Pub. No.: WO98/41334

PCT Pub. Date: Sep. 24, 1998

(30) Foreign Application Priority Data

Mar. 15, 1997 (DE) ..... 197 10 878

(51) Int. Cl.[7] ..... B67D 5/00
(52) U.S. Cl. ..... 222/83
(58) Field of Search ..... 222/82, 83, 129, 222/326, 327

(56) References Cited

U.S. PATENT DOCUMENTS

| | | | | |
|---|---|---|---|---|
| 1,880,354 | * | 10/1932 | Mueller | 222/236 |
| 3,193,146 | | 7/1965 | Isgriggs et al. | 222/82 |
| 4,453,651 | | 6/1984 | Braithwaite et al. | 222/82 |
| 4,461,454 | | 7/1984 | Vadnais | 251/350 |
| 4,522,316 | * | 6/1985 | Hoffmann et al. | 222/327 |
| 4,722,449 | | 2/1988 | Dubach | 215/235 |
| 4,986,443 | | 1/1991 | Saur et al. | 222/1 |
| 5,297,697 | | 3/1994 | Boring | 222/83 |
| 6,000,578 | * | 12/1999 | Boissay | 222/83 |

FOREIGN PATENT DOCUMENTS

| | | |
|---|---|---|
| 416 446 | 1/1967 | (CH) . |
| 2 500 518 | 8/1982 | (FR) . |

* cited by examiner

*Primary Examiner*—Kevin Shaver
*Assistant Examiner*—David A. Bonderer
(74) *Attorney, Agent, or Firm*—Wayne C. Jaeschke; Stephen D. Harper; Kenneth Watov

(57) ABSTRACT

The invention relates to a cartridge system comprising a tubular cartridge pistol and a cartridge which can be inserted into the cartridge pistol. The outlet end of the cartridge protrudes out of the cartridge pistol when the cartridge is in an inserted position. The cartridge is provided with an attachment piece at the end for attaching an outlet nozzle. The aim of the invention is to improve the cartridge system in such a way that handling during operation of the system is considerably simplified and in particular no additional auxiliary elements are required apart from said cartridge system. To this end, the attachment piece is sealed with a pierceable membrane on the inside, and the outlet nozzle is provided with piercing elements at the attachment end for piercing the membrane. The piercing elements can be engaged with the attachment pierce.

19 Claims, 4 Drawing Sheets

CARTRIDGE SYSTEM

BACKGROUND

1. Field of the Invention

This invention relates generally to a cartridge system for dispensing adhesives, sealants, and similar materials, and more particularly comprising a tubular cartridge gun and a cartridge which is designed to be loaded into the cartridge gun and of which the outlet end projects from the cartridge gun in the loaded position, the cartridge being provided at its outlet end with a receiving spout for attaching a dispensing nozzle.

2. Discussion of Related Art

Known cartridge systems of this type comprise a tubular cartridge gun which, at the outlet end, has a push-through opening for the outlet end of the cartridge. At its outlet end, the cartridge has a receiving spout which is closed at its end and carries an external screwthread. Before a cartridge such as this—preferably made of plastic—is used, the cap-like end of the receiving spout has to be cut off with a knife so that a dispensing nozzle can be screwed onto the cartridge thus opened, and the cartridge thus equipped can be subsequently loaded into the cartridge gun.

A cartridge system of this type is relatively difficult to use because a knife or the like is needed to open the cartridge, but is often not within reach. Another disadvantage is that the cap-like end cut off has to be disposed of or drops uncontrollably onto the floor which is particularly undesirable when this cap-like end is soiled with the contents of the cartridge—something which cannot be ruled out. If the cartridge is filled, for example, with adhesive or a jointing compound, this can have unwanted consequences if, as a result, residues of the adhesive, for example, adhere to the floor.

3. Summary of the Invention

An object of the invention is to improve a cartridge system of the type previously mentioned in such a way that handling of the cartridge system in use would be considerably simplified and, in particular, requires no additional aids is apart from the cartridge system itself.

According to the invention, this and other objects are met by a cartridge system of the type mentioned above wherein the receiving spout is closed internally by a piercable membrane, and the dispensing nozzle is provided at its attachment end with piercing means designed to engage in the receiving spout to pierce the membrane.

By virtue of this design, there is no longer any need to use a knife or the like to open the cartridge, the cartridge is internally closed in the receiving spout by the membrane and can easily be opened quasi-automatically by the attachment of the dispensing nozzle to the receiving spout. The cartridge thus opened and equipped may then be normally loaded into the cartridge gun. Accordingly, when the cartridge is opened, there is no waste which could drop to the floor or would otherwise have to be disposed of.

In one preferred embodiment, the membrane is arranged inside the cartridge at the foot of the receiving spout. This avoids unwanted or accidental damage to the membrane before the cartridge is used because the membrane itself is protected. A protective cap may even be placed on the receiving spout. However, this cap cannot be soiled because the membrane separates the contents of the cartridge from the cap.

Alternatively, the membrane may be arranged in the vicinity of the outlet of the receiving spout.

In one particularly advantageous embodiment, the dispensing nozzle consists of a lower part designed to be fixed to the receiving spout, and an upper part designed for limited longitudinal displacement within the lower part, and which comprises the piercing means on its inner end. The lower part of the dispensing nozzle may thus be fitted or screwed onto the receiving spout of the cartridge with the cartridge still closed and the membrane of the cartridge is automatically pierced by longitudinally displacing the upper part of the nozzle into the lower part, thus releasing the opening of the cartridge. The upper part of the dispensing nozzle may advantageously be displaced after the cartridge has been loaded into the cartridge gun.

In another particularly advantageous embodiment of the invention, in which the handling of such a two-piece dispensing nozzle for opening the cartridge is further simplified, the upper part and lower part of the dispensing nozzle comprise first and second corresponding detent means at a distance apart from one another, the upper part of the nozzle being designed for longitudinal displacement against the effect of the first detent means into the detent position of the second detent means. This embodiment ensures that the two parts of the dispensing nozzle are initially in the first detent position in which the piercing means of the upper part of the nozzle, do not protrude downwards from the lower part of the nozzle and that the upper part of the nozzle is only displaced from the first detent position into the second detent position, in which the piercing means pierce the membrane of the cartridge, after the lower part of the nozzle has been fitted or screwed onto the receiving spout of the cartridge.

In order further to simplify the displacement of the upper part of the nozzle into the lower part, the upper part of the nozzle is externally provided with an encircling stop. This stop may serve as a grip handle.

Another particularly preferred embodiment of the invention is characterized in that the cartridge gun has an outlet end in the form of a pot, which locally surrounds the upper and lower parts of the nozzle and has an opening for the upper part of the nozzle to pass through, the size of this opening being such that, in the loaded position, the upper part of the nozzle comes into contact through its stop with the rim of the outlet opening. This embodiment makes the cartridge system much easier to handle. First, the lower part of the nozzle with the upper part therein is screwed onto the cartridge, after which the cartridge thus equipped is loaded into the cartridge gun, the stop of the upper part of the nozzle coming into contact during loading with the rim of the outlet opening of the pot-shaped outlet end of the cartridge gun, so that by further loading of the cartridge into the cartridge gun or actuation of the trigger lever, which pushes the piston rod and hence the cartridge forward—the upper part of the nozzle is automatically displaced from the first into the second detent position and hence into the lower part of the nozzle through the striking of the stop against the rim of the pot-shaped outlet end of the cartridge gun, whereby the membrane is opened or rather pierced.

In another embodiment of the invention intended, for example, for the modification of normal cartridge guns, the pot-shaped outlet end is made as a separate part designed for insertion into the cartridge gun.

In another particularly advantageous embodiment, a shut-off cock is integrated into the upper part of the nozzle. This shut-off cock is intended to prevent product from issuing from the nozzle after application. In addition, by adjusting the size of the throughflow opening of the shut-off cock, the volumetric flow rate of product can be varied—in addition to the buildup of pressure—at the handle of the cartridge gun.

Above the shut-off cock, there can either be a screwthread on the upper part of the nozzle, onto which a typical commercially available nozzle can be screwed, or the shut-off cock can open directly into the tip of the nozzle.

BRIEF DESCRIPTION OF THE DRAWINGS

The invention is described in more detail in the following with reference to the accompanying drawings, in which like items are identified by the same reference designation, wherein.

DETAILED DESCRIPTION OF THE INVENTION

Figure 1:
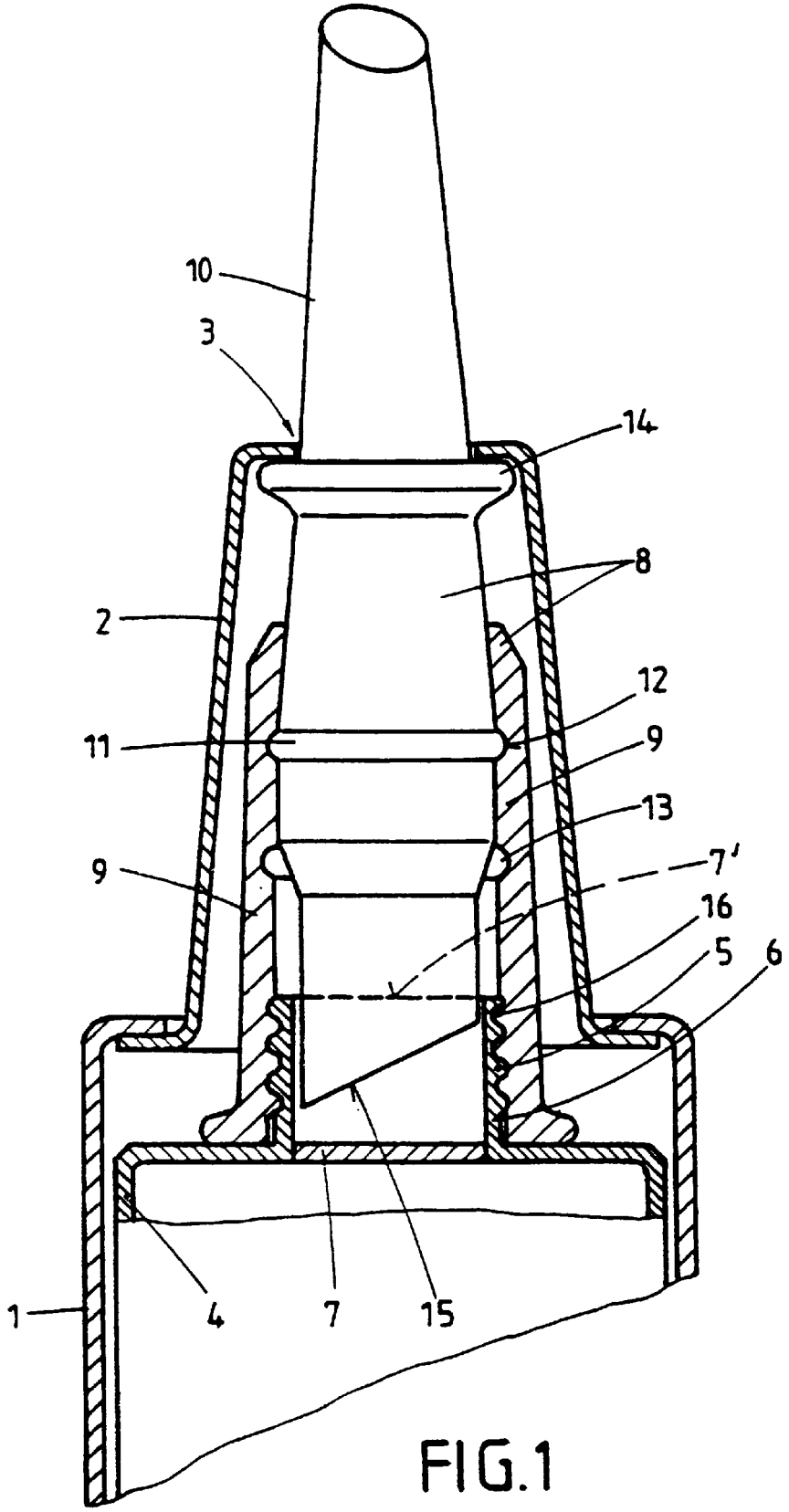
FIG. 1 is a partial section through a first embodiment of a cartridge system according to the invention.

Of the cartridge system according to the invention, FIG. 1 only shows parts of the tubular cartridge gun which is denoted by the reference numeral 1. A pot-shaped outlet end 2 with an opening 3 in its front end is inserted into the front outlet opening of the cartridge gun 1.

In addition, the cartridge system has a tubular cartridge 4, for example made of plastic, which is provided at its outlet end with an externally screwthreaded (screwthread 6) receiving spout 5. In the vicinity of the receiving spout 5, the cartridge 4 is internally closed by a membrane 7. Alternatively, the membrane 7 may also be arranged near the outlet of the receiving spout 5. This position of the membrane is shown in chain lines and denoted by the reference numeral 7' in FIG. 1.

A dispensing nozzle 8 is designed to be screwed onto the receiving spout 5 of the cartridge 4. In the embodiment shown in FIG. 1, the outlet nozzle 8 consists of two parts, namely a lower part 9 and an upper part 10. The upper part 10 of the nozzle is arranged for limited longitudinal displacement within the lower part 9 of the nozzle. The displacement is limited by detent means, namely first detent means and second detent means. The first detent means are formed by an encircling detent bead 11 on the outer circumference of the upper part 10 of the nozzle, and a corresponding detent groove 12 in the lower part 9 of the nozzle, while the second detent means are formed by the detent bead 11 and a second detent groove 13—lying further inwards—in the lower part 9 of the nozzle.

In addition, outside the region inserted into the lower part 9, the upper part 10 of the nozzle comprises an encircling stop 14. A pointed spike-like end 15 is formed on the inner end of the upper part 10 of the nozzle and, appropriately positioned, is designed to pierce the membrane 7 of the cartridge 4. The geometric dimensions of the upper part 10 of the nozzle are selected so that, when the detent bead 11 is in the first detent groove 12 of the lower part 9 of the nozzle, the piercing means 15 are unable to enter so far into the receiving spout 5 that they can come into contact with the membrane 7 in the screwed-on position of the internally screwthreaded (screwthread 16) lower part 9 of the nozzle. If the upper part 10 of the nozzle is pushed into the lower part 9 against the detent effect of the first detent means 11,12 until the detent bead 11 engages in the second detent groove 13, the distance of the stop 14 is selected so that the stop 14 does not impede this movement, but remains in contact for example with the free end of the lower part 9 of the nozzle in this position. At the same time, the piercing means 15 are arranged so that they pierce, i.e. open, the membrane 7 in this position.

The cartridge system is handled by initially screwing the nozzle 8 onto the cartridge 4 or rather the receiving spout 5 of the cartridge 4 in the illustrated position of the lower part 9 and upper part 10 of the nozzle. The cartridge 4 thus equipped is then loaded into the cartridge gun in such a way that the stop 14 comes up against the rim of the opening 3 of the pot-shaped outlet end 2 of the cartridge gun 1. The cartridge 4 is then further loaded into the cartridge gun 1 in such a way that the upper part 10 of the nozzle is pushed into the lower part 9 under the effect of the contact made by the stop 14. When the gun 1 is actuated, the cartridge 4 is pressed forwards so that the detent bead 11 engages in the second detent groove 13. During this movement, the membrane 7 is pierced by the piercing means 15 and the cartridge 4 is opened so that the cartridge system is ready for use.

Figure 2:
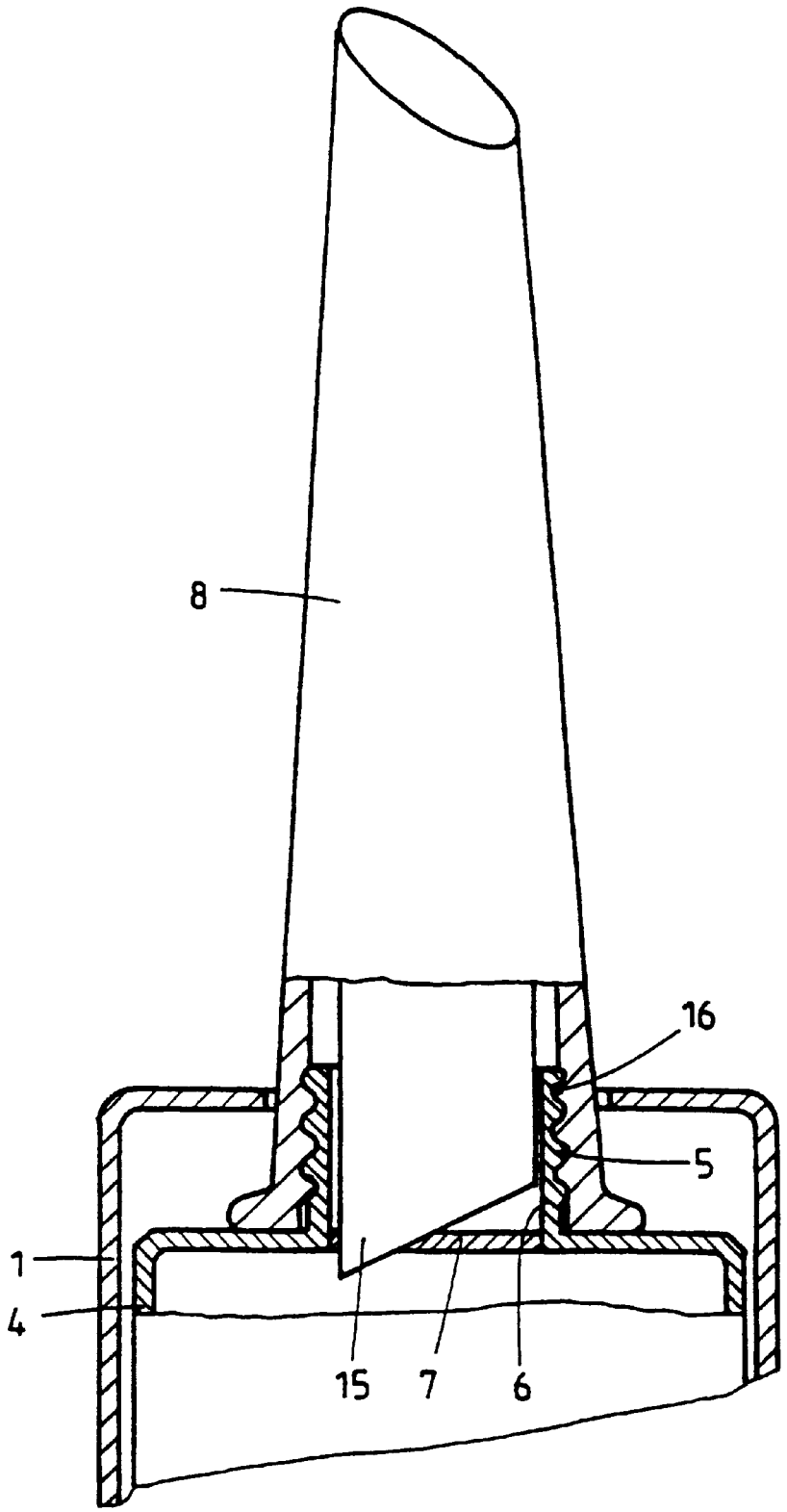
FIG. 2 is a similar illustration of a second embodiment.

FIG. 2 shows a modified embodiment using the same reference numerals as in FIG. 1 for the same parts. In this embodiment, the tubular cartridge gun 1 is not provided with a pot-shaped outlet end 2, i.e. it is conventionally designed. The cartridge 4 is designed in the same way as in the embodiment shown in FIG. 1. Only the nozzle 8 is different, consisting in this embodiment of a single part. At its attachment end, the dispensing nozzle 8 has an internal screwthread 16 with which it can be screwed onto the receiving spout 5 of the cartridge 4. At its attachment end, the dispensing nozzle 8 also comprises piercing means 15 which protrude downwards from the dispensing nozzle 8. If, now, the dispensing nozzle 8 is screwed onto the receiving spout 5, the piercing means 15 pierce the membrane 7 of the cartridge 4. The cartridge 4 thus equipped and opened is then loaded into the cartridge gun 1 and the cartridge system is ready for use.

Figure 3:
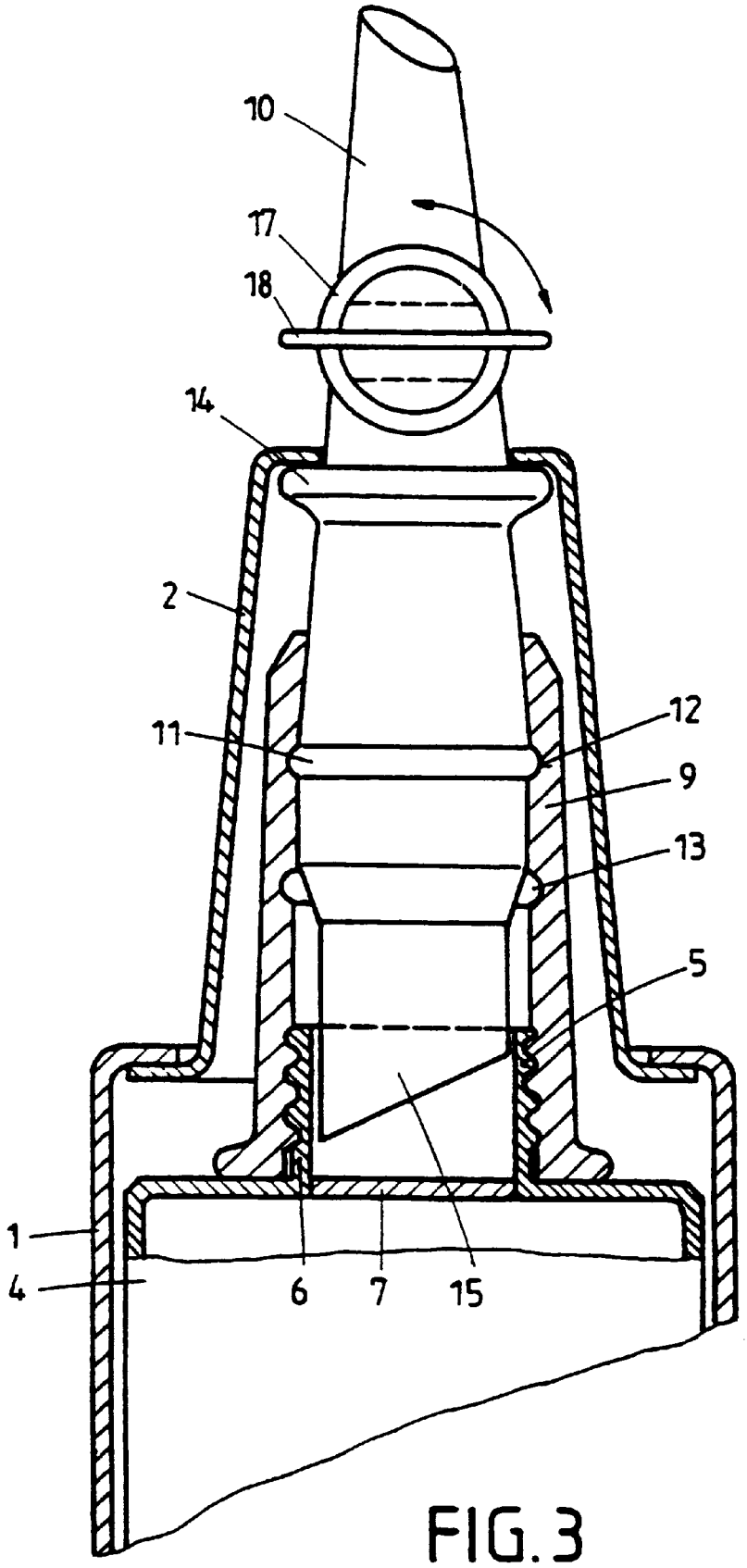
FIG. 3 shows the embodiment according to FIG. 1 with a shut-off cock integrated into the upper part of the nozzle.

FIG. 3 shows another embodiment of a cartridge system according to the invention, which largely corresponds to the embodiment illustrated in FIG. 1. Accordingly, the same reference numerals as in FIG. 1 are used to denote the same parts. In the embodiment shown in FIG. 3—in contrast to that shown in FIG. 1—a shut-off cock 17 and a handling grip 18 are integrated into the upper part 10 of the nozzle. By closing the shut-off cock 17, it is possible to close the cartridge system after application so that no more product is able to issue from the nozzle. This closed position is shown in FIG. 3. In addition, by adjusting the size of the through-flow opening of the shut-off cock 17, which is indicated by the double arrow in FIG. 3, the volumetric flow rate can be varied—in addition to the buildup of pressure—at the handle of the cartridge gun. Above the shut-of cock 17, the upper part 10 of the nozzle merges into the nozzle tip.

Figure 4:
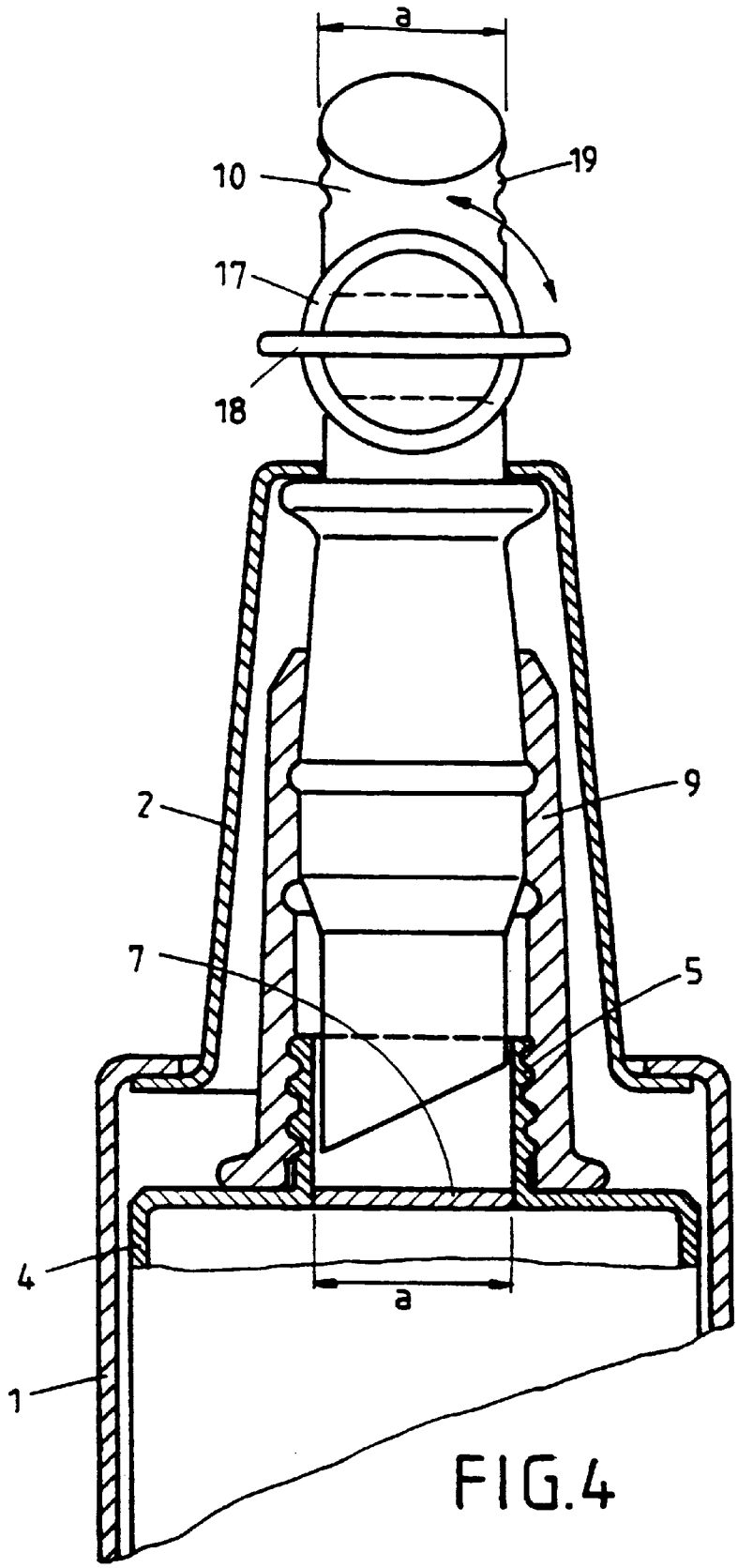
FIG. 4 shows a slightly modified version of the embodiment illustrated in FIG. 3.

FIG. 4 shows another embodiment which largely corresponds to the embodiment of FIG. 3. The only difference is that, in the embodiment shown in FIG. 4, the upper part 10 of the nozzle opens above the shut-off cock 17 into an external screwthread 19 onto which a commercially available nozzle endpiece (not shown) can be screwed. In this embodiment, the upper part 10 of the nozzle has substantially the same passage cross-section over its entire length, which is indicated by the diameter letter a.

The invention is not of course confined to the illustrated embodiments. Further modifications are possible without departing from the basic concept. Thus, in the embodiment shown in FIG. 1, the cartridge gun 1 may also be made in one piece with the pot-shaped outlet end 2, etc. Such modifications are meant to be covered by the spirit and scope of the appended claims.

What is claimed is:

1. A cartridge system comprising a hollow tubular cartridge gun, and a replaceable cartridge which is configured to fit into the hollow portion of said cartridge gun, said cartridge including an outlet end configured to project from the cartridge gun in the loaded position, the cartridge being provided at said outlet end thereof with a receiving spout for attaching a dispensing nozzle including an upper part, and a lower part with an attachment end, the receiving spout being closed internally by a piercable membrane, and the dispensing nozzle being provided at its said attachment end with piercing element(s) positioned to engage in the receiving spout to pierce the membrane, wherein the lower part of the dispensing nozzle is removably connected to the receiving spout, and the upper part of the dispensing nozzle has a middle portion secured within said lower part for limited longitudinal displacement therein, and which comprises the piercing element(s) on an inner end, the upper part and lower part of the dispensing nozzle including first and second corresponding detent mechanisms at a distance apart from one another, the upper part of the nozzle being designed for longitudinal displacement against the effect of the first detent mechanism into the detent position of the second detent mechanism.

2. A cartridge system as claimed in claim 1, wherein the upper part of the nozzle comprises an encircling stop on its outside.

3. A cartridge system as claimed in claim 2, wherein the cartridge gun has an outlet end configured as a truncated cone which locally surrounds the upper and lower parts of the nozzle and has an opening for the upper part of the nozzle to pass through, the size of this opening being such that, in the loaded position, the upper part of the nozzle comes into contact through its stop with the rim of the outlet opening.

4. A cartridge system as claimed in claim 2, wherein the membrane is arranged inside the cartridge at a foot of the receiving spout.

5. A cartridge system as claimed in claim 2, wherein the membrane is arranged near an outlet of the receiving spout.

6. A cartridge system as claimed in claim 2, further including a shut-off cock integrated into the upper part of the nozzle.

7. A cartridge system as claimed in claim 3, wherein the pot-shaped outlet end is made as a single part designed for insertion into the cartridge gun.

8. A cartridge system as claimed in claim 3, wherein the membrane is arranged inside the cartridge at a foot of the receiving spout.

9. A cartridge system as claimed in claim 3, wherein the membrane is arranged near an outlet of the receiving spout.

10. A cartridge system as claimed in claim 3, further including a shut-off cock integrated into the upper part of the nozzle.

11. A cartridge system as claimed in claim 7, wherein the membrane is arranged inside the cartridge at a foot of the receiving spout.

12. A cartridge system as claimed in claim 7, wherein the membrane is arranged near an outlet of the receiving spout.

13. A cartridge system as claimed in claim 7, further including a shut-off cock integrated into the upper part of the nozzle.

14. A cartridge system as claimed in claim 1, wherein the membrane is arranged inside the cartridge at a foot of the receiving spout.

15. A cartridge system as claimed in claim 14, further including a shut-off cock integrated into the upper part of the nozzle.

16. A cartridge system as claimed in claim 1, wherein the membrane is arranged near an outlet of the receiving spout.

17. A cartridge system as claimed in claim 16, further including a shut-off cock integrated into the upper part of the nozzle.

18. A cartridge system as claimed in claim 1, further including a shut-off cock integrated into the upper part of the nozzle.

19. A cartridge system as claimed in claim 18, further including a nozzle endpiece having internal screw threads at one end for screwing onto external screw threads on the free end of the upper part of the nozzle.

* * * * *